United States Patent [19]

Rottmayr

[11] Patent Number: 4,566,669

[45] Date of Patent: Jan. 28, 1986

[54] MOLD FOR CASTING REINFORCED CONCRETE PANEL ASSEMBLY ELEMENTS

[75] Inventor: Josef Rottmayr, Munich, Fed. Rep. of Germany

[73] Assignee: Aloisius Assmann, Enger, Fed. Rep. of Germany; a part interest

[21] Appl. No.: 560,604

[22] Filed: Dec. 12, 1983

Related U.S. Application Data

[63] Continuation-in-part of Ser. No. 552,854, Nov. 17, 1983, which is a continuation of Ser. No. 291,803, Aug. 10, 1981, abandoned.

[30] Foreign Application Priority Data

Aug. 23, 1980 [DE] Fed. Rep. of Germany ..... 3031868

[51] Int. Cl.[4] ..... B28B 7/20

[52] U.S. Cl. ..... 249/160; 249/162; 425/DIG. 58

[58] Field of Search ..... 249/160, 161, 162, 163, 249/164, 27, 166, 170; 52/589; 425/DIG. 5, DIG. 58, 805

[56] References Cited

U.S. PATENT DOCUMENTS

| | | | |
|---|---|---|---|
| 923,521 | 6/1909 | Herron | 249/161 |
| 1,314,725 | 9/1919 | Young | 249/160 |
| 1,770,368 | 7/1930 | Fahlman | 249/162 |
| 2,217,140 | 10/1940 | Smith | 249/161 |
| 3,417,533 | 12/1968 | Sparling | 52/589 |
| 3,582,034 | 6/1971 | Tsuzuki | 249/160 |
| 4,210,196 | 7/1980 | Weiner | 425/DIG. 5 |

FOREIGN PATENT DOCUMENTS

| | | | |
|---|---|---|---|
| 322428 | 5/1975 | Austria . | |
| 0046541 | 3/1982 | European Pat. Off. | 249/13 |
| 14566 | 1/1956 | Fed. Rep. of Germany . | |
| 2260241 | 6/1974 | Fed. Rep. of Germany . | |
| 2311725 | 9/1974 | Fed. Rep. of Germany . | |
| 2438376 | 2/1976 | Fed. Rep. of Germany . | |
| 61329 | 4/1968 | German Democratic Rep. . | |
| 94693 | 12/1972 | German Democratic Rep. . | |
| 158569 | 11/1978 | Netherlands | 249/160 |

OTHER PUBLICATIONS

Borrego, John, *Space Grid Structures,* MIT Press, Cambridge, Mass., 1968, pp. 57–79.

Bauplanung–Bautechnik vol. 32, No. 3, Mar. 1978, p. 141, FIG. 1, 2.

*Primary Examiner*—Jay H. Woo
*Assistant Examiner*—James C. Housel
*Attorney, Agent, or Firm*—W. G. Fasse; D. H. Kane, Jr.

[57] ABSTRACT

An assembly element for steel reinforced truss-type panels is cast as a one piece unit in a mold so constructed that the struts of the element are rigidly secured to the upper and lower chord directly as the result of the casting. For this purpose the mold has a lower bottom cap, an upper top base and laterally movable side wall sections. A pair of lateral side wall sections interconnects a bottom cap portion and a top base portion to form a mold part. Thus, the number of mold parts correspond to the number of struts in the element, whereby the element may be removed from the mold in spite of the fact that the top chord and bottom chord are rigidly interconnected already in the mold.

4 Claims, 5 Drawing Figures

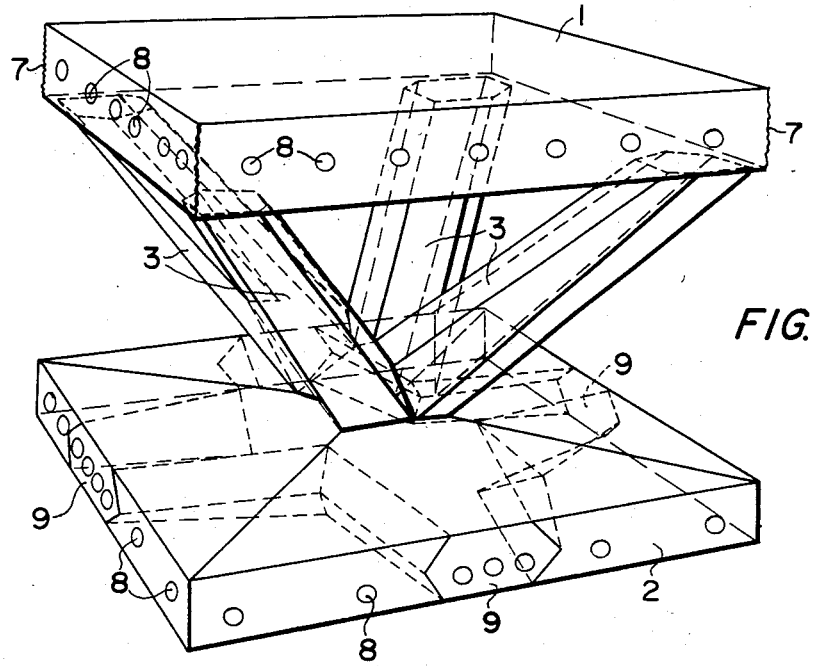
FIG. 1
FIG. 2
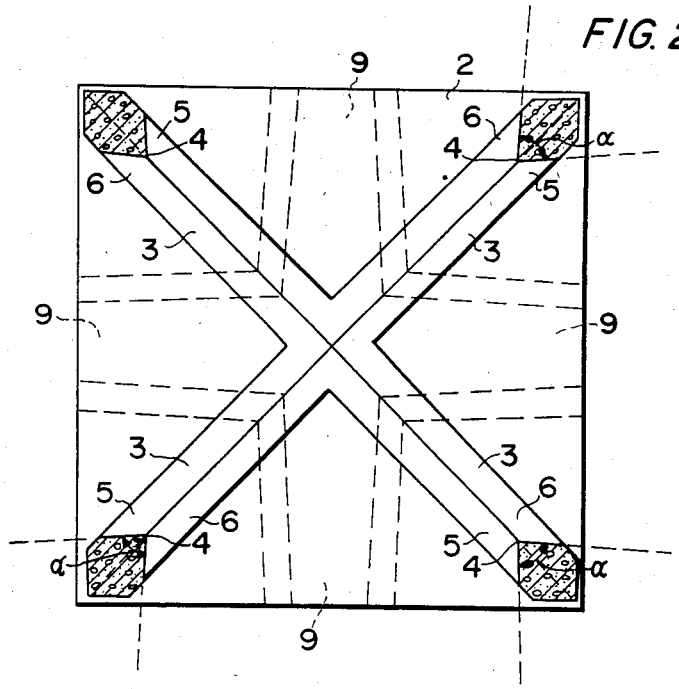

MOLD FOR CASTING REINFORCED CONCRETE PANEL ASSEMBLY ELEMENTS

CROSS-REFERENCE TO RELATED APPLICATION

The present application is a continuation-in-part application of my copending application U.S. Ser. No. 552,854, filed: Nov. 17, 1983, which is a file wrapper continuation of U.S. Ser. No. 291,803, filed: Aug. 10, 1981, abandoned and refiled as file wrapper continuation under Ser. No. 552,854 on Nov. 17, 1983.

FIELD OF THE INVENTION

The invention relates to a mold for precasting an assembly element which is poured in one piece, for steel reinforced concrete truss-type panels. Such mold comprises a plurality of separately movable components for the production of these assembly elements.

An assembly element which is poured in one piece in the shape of a girder is known from German Pat. No. 94,693. This known assembly element can only be utilized for construction components with a uniaxial gross load effect. When, for example, a quadratic or rectangular ceiling field having four studs is to be covered with the assembly elements, girders or supporting beams are necesssary in one direction upon which the known assembly elements are placed.

An assembly element for reinforced concrete truss-type panels in the shape of an elongated panel strip has become known from German Patent Publication (DE-OS) No. 2,311,725, which can also be used for construction units with a biaxial gross load effect. In comparison with an assembly element for a uniaxial gross load effect in connection with girders or supporting beams, such an assembly element for a biaxial gross load effect, exhibits a smaller structural height and a saving of material and therefore weight. However, without any unjustifiably large expenditure for the mold, it was not possible to pour the assembly element in one piece. Rather, the lower chord plate with the struts had to be completely poured first, and the upper chord plate had to be put on in a separate working operation. Additionally, the lower chord plate had to have openings of specific shape and size for the removal of the mold.

OBJECT OF THE INVENTION

It is the object of the invention to provide a casting mold for producing assembly elements, which are poured in one piece and which may be used for taking up a biaxial gross load effect, and which is further substantially free of statically superfluous construction materials.

SUMMARY OF THE INVENTION

According to the invention there is provided a mold for casting an assembly element for steel reinforced concrete truss-work panels including upper and lower chord means interconnected by three, four or six struts which form a single junction in the center of one of the chord means and fan out toward an edge zone of the other of said chord means, comprising a plurality of mold parts corresponding in number to the number of struts, said mold parts comprising separation surfaces enclosing the same angle as the directions of the struts projected into a horizontal plane.

In other words, each movable mold part comprises a bottom portion, a top portion, and movable side wall portions or sections. The side walls of these movable mold parts form the strut molds proper and have separation surface angles which correspond to the projected angles of the strut directions, whereby the removal of the assembly element from the mold is facilitated.

A particularly advantageous casting mold is characterized in that all movable mold side walls are identical to each other which reduces the costs of the mold and simplifies its construction.

BRIEF FIGURE DESCRIPTION

The invention wil now be explained in more detail and by way of example with the aid of the accompanying drawings, wherein:

FIG. 1 shows a perspective view of an assembly element, which is cast in one piece in a mold according to the invention for a biaxial gross load effect;

FIG. 2 is a section through the assembly element, according to FIG. 1, below the upper chord plate;

Figure 3:
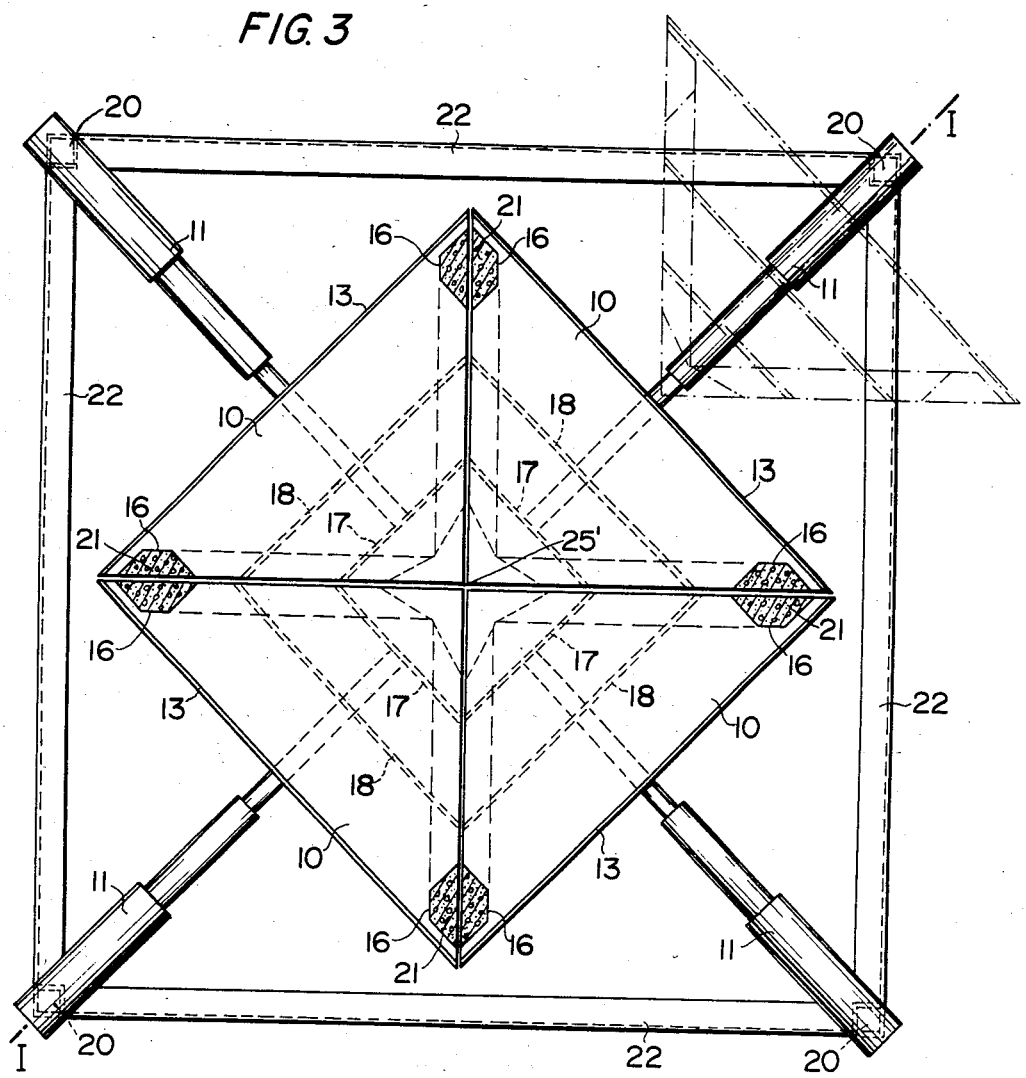
FIG. 3 is a schematic top view of a mold according to the invention for the production of an assembly element according to FIGS. 1 and 2.

DETAILED DESCRIPTION OF PREFERRED EXAMPLE EMBODIMENTS AND OF THE BEST MODE OF THE INVENTION

The assembly element shown in FIGS. 1 and 2 comprises an upper chord plate or component 1, a lower chord plate or component 2 and four struts 3. As best seen in FIG. 2, the struts 3 extend out from the midpoint of the lower chord 2 and their directions as projected onto a horizontal plane enclose an angle of 90° with each other. The cross-section of the struts 3, again as best seen in FIG. 2, is hexagonal, whereby a corner points toward the center of the assembly element. The strut surfaces 5 and 6 which define this corner form an angle $\alpha$, in a horizontal section, which is smaller than 90°. In that way, the strut surfaces 5 or 6 facing the adjacent strut 3 form an angle, in the horizontal section, with the opposite strut surface 6 or 5 of the adjacent strut, which angle opens in a direction away from the center of the assembly element. thus, it is assured that no back taper exists in the assembly element in the direction of the angle bisector between two adjacent projected strut directions 3, so that a satisfactory removal from the casting mold in the direction of this angle bisector is possible. This angle need only be very small, that is to say, the surfaces 5 and 6 need form, in the horizontal section, and angle $\alpha$ that is a little smaller than 90°, for example 89°. Additionally, the cross-sectional shape of the struts 3 is arbitrary, a hexagonal cross-section is in no way required. If the horizontal section has a curved contour of the strut, the remarks relating to the angle $\alpha$ pertain to the tangents at the corner 4. The struts 3 lead to the outer corners of the upper chord 1, which in the illustrated example embodiment has a quadratic shape, as does the lower chord 2. They end at a distance from the outer sides of the upper chord 1, so that a circumferential horizontal surface is available as a support for the joint sealing mold. Horizontal grooves 7 are formed on the outer sides of the upper chord 1, which facilitate the transmission of shearing force from one assembly element to an adjoining one, when they are in the assembled and poured or cast state. Horizontal channels 8 are provided in the upper chord 1, as well as in the lower chord 2 into which reinforcements or tensioning components may be pushed during the assembly of the assembly elements. As shown, such channels 8 in the upper chord 1 as well as in the lower chord 2 extend in two directions or orthogonal to each other.

In the form of construction described so far, the lower chord 2 is square as is the upper chord 1. They can, however, also be rectangular. In both cases, the lower chord 2 can just as well be made of bars or arms integrally cast of concrete 9, that are indicated by broken lines within the lower chord 2. These cast concrete arms 9 lie in the direction of the angle bisector between two strut directions as projected on a horizontal plane and taper somewhat toward their ends outwardly from the center of the lower chord 2, so that the removal from the mold is faciliated. The cast concrete arms 9 may also extend in the direction of the projected strut directions. Furthermore, the upper chord may also be made of bars which must, however, lie in the direction of the projected strut directions. These arms 9 may, for example, have a shape as shown in FIG. 1 or they may have a simpler shape, for example with a rectangular cross-section.

In place of the four struts 3, three or six struts may be used, whereby, naturally, the given angles of 90° are replaced by 360°: 3=120; or 360°: 6=60°. This replacement applies to the angle between the strut directions as projected onto a horizontal plane as well as to the horizontal angle $\alpha$ between the strut surfaces 5 and 6. In case the upper and/or lower chord components are reduced to cast concrete arms, the number of these arms must be selected correspondingly. Generally, the number of these arms must at least be equal to the number of struts. Additionally, in the lower chord plate there is the possibility of arranging only three arms with six struts.

Figure 4:
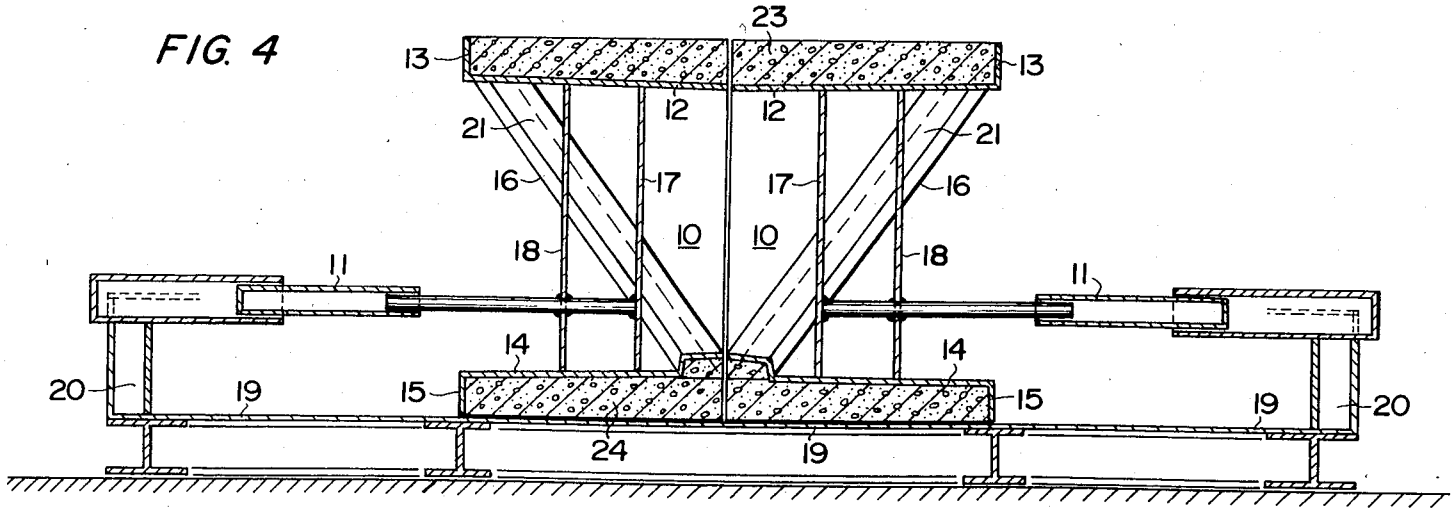
FIG. 4 is a schematic sectional view along the line I—I in FIG. 3.

A mold according to the invention for the production of an assembly element according to FIGS. 1 and 2 is illustrated in FIGS. 3 and 4. The mold comprises, for example, four identical mold parts or mold sections 10, which are held in a manner allowing them to slide toward and away from each other on telescopic guide rods 11 which run radially relative to each other and relative to a central axis 25 extending through the center of FIG. 3 perpendicularly to the plane of the drawing. Each mold part 10 comprises a portion of an upper mold cap 12 with a mold side wall 13, a portion of a bottom mold base 14 with a mold side wall 15, and two halves of strut molds 16, which are open toward the separation plane, as can best be seen in FIG. 3. In the top view the upper mold cap 12 and the lower mold base 14 have the shape of an isosceles rectangular triangle which lies symmetrically to the axis of the respective telescoping guide rod 11, as best seen in FIG. 3. Each mold part or section 10 is stiffened by partitions 17 and 18 which are connected to their respective telescopic guide rod 11. A typical mold base 19 is located below the mold side wall 15 of the lower mold base 14.

The telescoping guide rods 11 rest on the outside on supports 20, which are secured to the mold base 19 and are connected to each other by a circumferential L-sectional member 22. The guide rods 11 move the mold parts or sections 10 substantially horizontally in parallel to the mold base 19 forming a substantially horizontally extending flat support surface.

For the production of an assembly element according to FIGS. 1 and 2, the four mold parts 10 shown in FIGS. 3 and 4 are brought into the position shown in FIGS. 3 and 4, that is, they are pushed together so that the upper mold cap 12 with the mold side walls 13, as well as the bottom mold base 14 with the mold side walls 15, together form, for example, square casting cavities 23 and 24, whereby reinforcing steel rods or cores or sleeves are installed for the formation of the channels 8 in the usual manner. When the concrete mix is poured it is first introduced into the upper casting cavity 23, whereby it flows through the strut cavities 21, formed by two respective strut half molds 16, into the lower casting cavity 24. For this purpose there are holes in the bottom of the upper mold cavity 23 where the strut cavities 21 enter into the upper mold cavity 23. Similarly there are holes in the top of the lower mold cavity 24 where the lower ends of the strut cavities 21 enter into the lower cavity 24. Alternately, the concrete mix may be pressed into the lower casting cavity 24 and then rise through the strut cavities 21 into the upper casting cavity 23. In both instances the ends of the concrete struts are directly embedded in the concrete of the upper and lower chords as a result of the concrete pouring or casting by pressing for rigidly interconnecting the upper and lower chords to form a one piece, integral assembly element. After the concrete has hardened, the four mold parts 10 are pulled back into the position illustrated by the dotted lines in FIG. 3 by means of the respective telescoping guide rod 11. Then the completed assembly element may be lifted off of the mold base 19 and be transported to storage.

Figure 5:
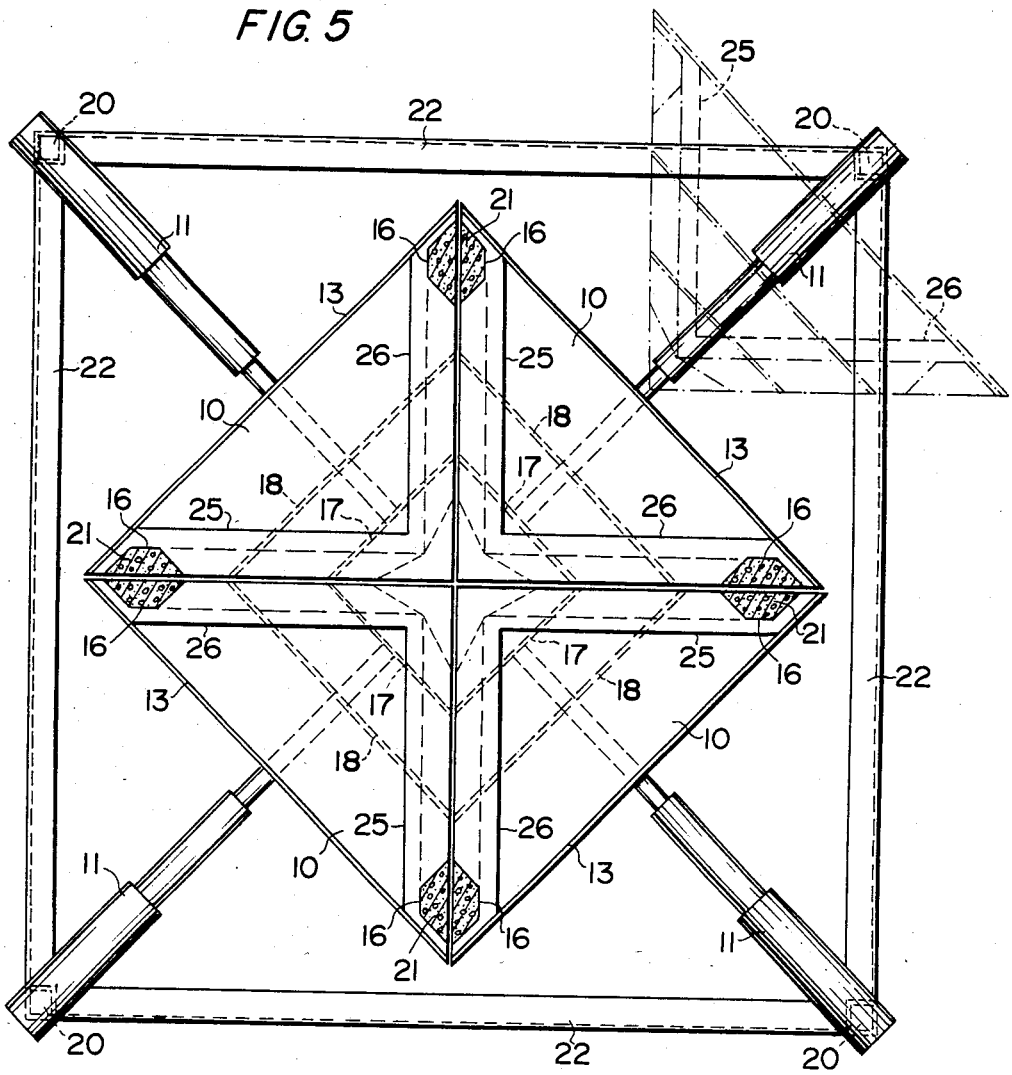
FIG. 5 is a view similar to FIG. 3, but showing a modification of an upper and lower casting cavity for making integral upper and lower chord arms having a substantially rectangular cross-section.

If bar members 9 are to be used in place of a continuous chord 1 or 2, the mold cap 12, 13 and the mold base 14, 15 are shaped accordingly. FIG. 5 shows an embodiment of a mold quite similar to that of FIG. 3, but adapted for casting upper chords in the form of arms as described above, rather than in the form of square plates as is the case in FIG. 3. For this purpose divider walls 25 and 26 are inserted into the upper mold cavity 23. In the simplest embodiment the chord arms may have a rectangular cross-section whereby the divider walls 25 and 26 extend straight in the upper mold cavity 23 and are held in place by the mold side walls 13 as shown. In this embodiment the strut cavities 21 also interconnect the upper and lower mold cavities. The lower mold cavity 24 may also be equipped with divider walls, not shown, for casting chord arms rather than chord plates. Such a chord arm is, for example, shown at 9 in FIGS. 1 and 2.

If another number of struts 3 is to be used, then a number of mold parts 10 corresponding to the number of struts is needed, which also are shaped like isosceles triangles the vertex angle of which is, however, equal to the angle between the directions of the struts as projected onto a horizontal plane. For example, three struts would require an angle of 120°. The upper chord 1 is, in the last case, preferably hexagonal, as is the lower chord 2, as long as they are both solid as shown in FIG. 1.

The mold parts 10 need not necessarily be arranged on the telescopic guide rods 11, they can also, for example, be guided by a pantograph, or they may rest directly on the mold base.

All struts 3 extend from the mid-point of a chord surface, the lower chord 2 in the illustrated example embodiment, thereby guaranteeing that in the one-piece pouring of an assembly element, including the lower and upper chords in the form of plates and/or arms, a satisfactory removal from the mold is possible since no back tapers result in the radial direction. This chord plane need not necessarily lie within the respective chord even though this is desirable for reasons of statics. A steel reinforced concrete truss-type panel with a three-dimensional supporting truss structure of assembly elements produced in one piece can thus be assembled without extra in-place casting operations at the construction site along the edges of a floor or ceiling and without any need for separately securing the top chord to the struts.

Although the invention has been described with reference to specific example embodiments, it will be appreciated that it is intended to cover all modifications and equivalents within the scope of the appended claims.

What is claimed is:

1. A mold system for casting a one piece three-dimensional assembly element for steel reinforced concrete truss-work panels including upper and lower chords extending in two planes which are parallel to each other in space, said upper and lower chords being interconnected by three, four or six struts which form a single junction in the center of one of the chords and fan out toward an edge zone of the other of said chords, comprising a substantially horizontally extending flat support surface (19) and means for forming a mold cavity on said flat support surface (19), said mold cavity forming means consisting exclusively of a plurality of mold sections corresponding in number to the number of said struts, means for moving said mold sections in parallel to said flat support surface, each strut having such a cross-sectional shape that it is free of any back taper for permitting a free substantially horizontal opening movement of said mold sections, said mold sections comprising first wall means forming separation surfaces enclosing the same angle as the directions of the struts projected into a horizontal plane defined by said flat support surface, said first wall means enclosing strut cavities therein for defining said struts, said first wall means having wall sections without any back tapers therein and extending only in directions permitting a withdrawal movement of the respective mold section in parallel to said flat support surface, said mold sections forming an open bottom closed by said flat support surface (19) and an open top for pouring a concrete mix into said mold and for screeding off excess concrete mix, and wherein said mold sections comprise second wall means defining an upwardly open upper chord mold cavity (23) for molding an upper chord, third wall means defining a downwardly open lower chord mold cavity (24) for molding a lower chord, said first wall means (16) enclosing said strut cavities (21) so that said strut cavities operatively interconnect said upper and lower chord mold cavities for filling both chord mold cavities and said strut cavities substantially simultaneously, whereby it is possible to cast the upper chord, the lower chord and all struts as a one piece unit which, upon hardening of the concrete mix, remains standing on said flat support surface (19) when said mold sections are moved substantially horizontally away from each other.

2. The mold system of claim 1, wherein at least one of said second or third wall means defining said chord mold cavities comprises separation wall members for casting a chord in the form of an arm as an integral component of the cast element.

3. The mold system of claim 1, wherein said first wall means defining said strut cavities include at least one wall section extending in parallel to a horizontal movement direction of the respective mold section.

4. The mold system of claim 1, wherein all of said mold sections are of identical shape for casting an assembly element in which all angles between the projected strut directions are the same.

* * * * *